US010273425B2

(12) United States Patent
Tabibi et al.

(10) Patent No.: US 10,273,425 B2
(45) Date of Patent: Apr. 30, 2019

(54) POLYOL CARRIER FLUIDS AND FUEL COMPOSITIONS INCLUDING POLYOL CARRIER FLUIDS

(71) Applicant: Afton Chemical Corporation, Richmond, VA (US)

(72) Inventors: Makaye Tabibi, Richmond, VA (US); Scott D. Schwab, Richmond, VA (US); Charles S. Shanahan, Richmond, VA (US); William J. Colucci, Glen Allen, VA (US)

(73) Assignee: Afton Chemical Corporation, Richmond, VA (US)

( * ) Notice: Subject to any disclaimer, the term of this patent is extended or adjusted under 35 U.S.C. 154(b) by 125 days.

(21) Appl. No.: 15/457,357

(22) Filed: Mar. 13, 2017

(65) Prior Publication Data

US 2018/0258361 A1 Sep. 13, 2018

(51) Int. Cl.
*C10L 10/06* (2006.01)
*C10L 1/02* (2006.01)
(Continued)

(52) U.S. Cl.
CPC ..... *C10L 10/06* (2013.01); *C10L 1/023* (2013.01); *C10L 1/143* (2013.01); *C10L 1/221* (2013.01); *C10L 1/1883* (2013.01); *C10L 1/1985* (2013.01); *C10L 1/222* (2013.01); *C10L 1/223* (2013.01); *C10L 1/224* (2013.01); *C10L 1/2383* (2013.01); *C10L 10/04* (2013.01);
(Continued)

(58) Field of Classification Search
CPC ..... C10L 10/06; C10L 1/023; C10L 1/221; C10L 1/143; C10L 2200/0259; C10L 2270/023; C10L 1/1883; C10L 1/1985; C10L 1/222; C10L 1/223; C10L 1/224; C10L 1/2383; C10L 10/04; C10L 2200/0423
See application file for complete search history.

(56) References Cited

U.S. PATENT DOCUMENTS 2,425,755 A 8/1947 Roberts et al.
2,425,845 A 8/1947 Toussaint et al.
(Continued)

FOREIGN PATENT DOCUMENTS

CA 2089833 A1 8/1993
CN 1256302 A 6/2000
(Continued)

OTHER PUBLICATIONS

Extended European Search Report for corresponding EP Application No. 18161334.0 dated Jun. 11, 2018.
(Continued)

*Primary Examiner* — Cephia D Toomer
(74) *Attorney, Agent, or Firm* — Honigman LLP

(57) ABSTRACT

A carrier fluid or fluidizer for use in fuel performance additives or fuels including such additives is described herein. The novel carrier fluids include a unique blend of alkoxylated alcohols or polyols providing unexpected performance improvements to fuel performance additives and fuels incorporating the additives. The carrier fluids, when combined with at least a detergent, provide desired valve stick performance and unexpectedly improve the intake valve deposit performance at the same time.

18 Claims, 5 Drawing Sheets

(51) Int. Cl.

| | |
|---|---|
| ***C10L 1/22*** | (2006.01) |
| ***C10L 1/14*** | (2006.01) |
| *C10L 1/188* | (2006.01) |
| *C10L 1/198* | (2006.01) |
| *C10L 1/222* | (2006.01) |
| *C10L 1/223* | (2006.01) |
| *C10L 1/224* | (2006.01) |
| *C10L 1/2383* | (2006.01) |
| *C10L 10/04* | (2006.01) |

(52) U.S. Cl.
CPC ..... *C10L 2200/0259* (2013.01); *C10L 2200/0423* (2013.01); *C10L 2270/023* (2013.01)

(56) References Cited

U.S. PATENT DOCUMENTS

| | | | | |
|---|---|---|---|---|
| 2,448,664 | A | | 9/1948 | Fife et al. |
| 2,457,139 | A | | 12/1948 | Fife et al. |
| 2,475,755 | A | | 7/1949 | Pearson |
| 3,172,892 | A | | 3/1965 | Le Suer et al. |
| 3,202,678 | A | | 8/1965 | Stuart et al. |
| 3,216,936 | A | | 11/1965 | Le Suer |
| 3,219,666 | A | | 11/1965 | Norman et al. |
| 3,254,025 | A | | 5/1966 | Le Suer |
| 3,272,746 | A | | 9/1966 | Le Suer et al. |
| 3,361,673 | A | | 1/1968 | Stuart et al. |
| 3,676,089 | A | | 7/1972 | Morris |
| 4,038,043 | A | | 7/1977 | Garth |
| 4,152,499 | A | | 5/1979 | Boerzel et al. |
| 4,231,759 | A | | 11/1980 | Udelhofen et al. |
| 4,234,435 | A | | 11/1980 | Meinhardt et al. |
| 4,605,808 | A | | 8/1986 | Samson |
| 4,613,341 | A | | 9/1986 | Zaweski et al. |
| 4,729,769 | A | | 3/1988 | Schlicht et al. |
| 4,844,714 | A | * | 7/1989 | Vogel ..... C10L 1/143 44/335 |
| 4,877,416 | A | | 10/1989 | Campbell |
| 5,393,309 | A | | 2/1995 | Cherpeck |
| 5,514,190 | A | | 5/1996 | Cunningham et al. |
| 5,518,511 | A | | 5/1996 | Russel et al. |
| 5,575,823 | A | | 11/1996 | Wallace et al. |
| 5,620,486 | A | | 4/1997 | Cherpeck |
| 5,634,951 | A | | 6/1997 | Colucci et al. |
| 5,697,988 | A | | 12/1997 | Malfer et al. |
| 5,725,612 | A | | 3/1998 | Malfer et al. |
| 5,814,111 | A | | 9/1998 | Graham et al. |
| 5,873,917 | A | | 2/1999 | Daly |
| 5,876,468 | A | | 3/1999 | Moreton |
| 6,048,373 | A | | 4/2000 | Malfer et al. |
| 6,166,238 | A | | 12/2000 | Filipkowski et al. |
| 6,458,172 | B1 | | 10/2002 | Macduff et al. |
| 6,475,250 | B2 | | 11/2002 | Krull et al. |
| 6,548,458 | B2 | | 4/2003 | Loper |
| 6,695,890 | B1 | | 2/2004 | Hazel et al. |
| 6,730,773 | B2 | | 5/2004 | Heinen |
| 6,800,103 | B2 | | 10/2004 | Malfer et al. |
| 6,867,171 | B2 | | 3/2005 | Harrison et al. |
| 7,402,185 | B2 | | 7/2008 | Aradi et al. |
| 7,435,272 | B2 | | 10/2008 | Aradi et al. |
| 7,704,289 | B2 | | 4/2010 | Arters et al. |
| 7,766,982 | B2 | | 8/2010 | Colucci et al. |
| 8,097,570 | B2 | | 1/2012 | Boutout et al. |
| 8,231,695 | B2 | | 7/2012 | Cunningham et al. |
| 8,425,627 | B2 | | 4/2013 | Dietz et al. |
| 8,449,630 | B2 | | 5/2013 | Lange et al. |
| 8,486,876 | B2 | | 7/2013 | Brewer et al. |
| 8,496,716 | B2 | | 7/2013 | Lange et al. |
| 8,557,003 | B2 | | 10/2013 | Malfer et al. |
| 8,778,034 | B2 | | 7/2014 | Cunningham |
| 2004/0060226 | A1 | | 4/2004 | Bongart et al. |
| 2005/0066572 | A1 | | 3/2005 | Colucci et al. |
| 2005/0215411 | A1 | | 9/2005 | Mackney et al. |
| 2006/0070293 | A1 | | 4/2006 | Lange et al. |
| 2006/0168876 | A1 | | 8/2006 | Colucci et al. |
| 2006/0196110 | A1 | | 9/2006 | Schwahn et al. |
| 2006/0196111 | A1 | | 9/2006 | Colucci et al. |
| 2007/0245621 | A1 | | 10/2007 | Malfer et al. |
| 2008/0086936 | A1 | | 4/2008 | Cunningham et al. |
| 2009/0049740 | A1 | | 2/2009 | Hurst |
| 2009/0235576 | A1 | | 9/2009 | Volkel et al. |
| 2010/0005706 | A1 | | 1/2010 | Burgazli et al. |
| 2010/0132253 | A1 | | 6/2010 | Kaufman et al. |
| 2011/0162263 | A1 | | 7/2011 | Vilardo et al. |
| 2013/0237466 | A1 | | 9/2013 | Lange et al. |
| 2013/0247450 | A1 | | 9/2013 | Wolf |
| 2013/0255139 | A1 | | 10/2013 | Dolmazon et al. |
| 2013/0312318 | A1 | | 11/2013 | Peretolchin et al. |
| 2013/0227878 | A1 | | 12/2013 | Wolf et al. |
| 2013/0324665 | A1 | | 12/2013 | Shaikh et al. |
| 2016/0272912 | A1 | | 9/2016 | Voelkel et al. |
| 2016/0289584 | A1 | | 10/2016 | Russo et al. |

FOREIGN PATENT DOCUMENTS

| | | | |
|---|---|---|---|
| EP | 0016312 | A1 | 10/1980 |
| EP | 1293553 | A2 | 3/2003 |
| EP | 1411105 | | 4/2004 |
| EP | 1918355 | | 5/2008 |
| GB | 2493377 | A1 | 2/2013 |
| WO | 2004050806 | | 6/2004 |
| WO | 2005023965 | A1 | 3/2005 |
| WO | 2017097686 | | 6/2017 |

OTHER PUBLICATIONS

International Search Report and Written Opinion for corresponding WO Application No. PCT/US2018/022098 dated May 31, 2018.

* cited by examiner

Low Temperature Viscosity
Viscosity, cSt -20F
410
400
390
380
370
360
350
340
330
320
310
300
Fuel Additive 1
Fuel Additive 2
Fuel Additive 3

Average Intake Valve Stickiness
Average Intake Valve Stickiness lbs-sec
4000
3500
3000
2500
2000
1500
1000
500
0
Fuel Additive 1
Fuel Additive 2
Fuel Additive 3

Ford 2.3L Intake Valve Deposits
Average IVD, mg
180
160
140
120
100
80
60
40
20
0
Fuel A
Fuel B
Fuel C
Fuel D Ford 2.3L Intake Valve Deposits
Average IVD, mg
300
250
200
150
100
50
0
Fuel Additive 4
Fuel Additive 5
Fuel Additive 6

Ford 2.3L Intake Valve Deposits
Average IVD, mg
160
140
120
100
80
60
40
20
0
Fuel Additive 4
Fuel Additive 6
Fuel Additive 7

Average Intake Valve Stickiness
Average Intake Valve Stickiness lbs-sec
4000
3500
3000
2500
2000
1500
1000
500
0
Fuel Additive 4
Fuel Additive 5
Fuel Additive 6
Fuel Additive 8

Average Intake Valve Stickiness
Average Intake Valve Stickiness
lbs-sec
4000
3500
3000
2500
2000
1500
1000
500
0
Fuel Additive 4
Fuel Additive 6
Fuel Additive 7

Average Intake Valve Stickiness
Average Intake Valve Stickiness
Lbs-sec
4500
4000
3500
3000
2500
2000
1500
1000
500
0
Fuel Additive 9
Fuel Additive 10
Fuel Additive 11
Fuel Additive 12
Fuel Additive 13
Fuel Additive 14
Fuel Additive 15

Vanagon IVS Engine
Total # Stuck Valves
3.5
3
2.5
2
1.5
1
0.5
0
Fuel Additive 4
Fuel Additive 5
Fuel Additive 6
Fuel Additive 7

POLYOL CARRIER FLUIDS AND FUEL COMPOSITIONS INCLUDING POLYOL CARRIER FLUIDS

FIELD OF THE DISCLOSURE

This disclosure generally relates to carrier fluids for fuels that control deposits and intake valve performance. In particular, the disclosure relates to polyol carrier fluids, fuel performance additives including polyol carrier fluids, and fuels including polyol carrier fluids to control deposits and intake valve performance.

BACKGROUND

Over the years considerable work has been devoted to fuel performance additives for controlling (preventing or reducing), among other factors, deposit formation in fuel induction systems of spark-ignition internal combustion engines. In particular, additives that can effectively control fuel injector deposits, intake valve deposits, and combustion chamber deposits are often the focus of research activities and, despite these efforts, further improvements are frequently desired particularly in view of further advances in engine technology for improving fuel economy and engine wear.

One component of a typical fuel performance additive is a detergent. The role of the detergent is often to control the formation of intake valve deposits and injector deposits in internal combustion engines, as well as reduce or minimize the formation of deposits in the combustion chamber or remove existing deposits. The detergents are often utilized in combination with fluidizers or fluid carriers to improve the performance of the detergent. To enhance the detergent's ability to control deposits, detergents conventionally were added to fuels in conjunction with petroleum-based or synthetic carrier fluids. Petroleum-based carrier fluids include naphthenic and paraffinic base stock oils, and conventional synthetic fluids include low molecular weight polypropylenes, polyisobutylenes, poly-alpha olefins, esters, polyols, and polyalkyleneoxides. In recent years, the use of mineral oils as carriers has been reduced or eliminated due to their contributions to combustion chamber deposits.

While incorporating detergents and carriers in fuels has been effective in reducing intake valve deposits, the carrier fluid itself typically had little to no detergent activity. The carrier fluid aided in the dispersal of the detergent and often provided a fluidizing property to the fuel. Carrier fluids, in many applications, often include a relatively large portion of the additive package; thus, any reduction or improvement in carrier fluid technology can have significant effects on the performance and costs of the fuel performance additive.

SUMMARY

According to one aspect, a fuel additive composition is described herein suitable for spark-ignitable fuels. In one approach, the fuel additive composition includes detergent, an optional hydrocarbon solvent, and at least one liquid carrier including a blend of aliphatic C16 to C18 alkoxylated alcohols with each alkoxylated alcohol of the blend having 24 to 32 repeating units of alkylene oxide. In some approaches, the alkylene oxide is selected from the group consisting of ethylene oxide, propylene oxide, butylene oxide, copolymers thereof, and combinations thereof. In other approaches, the alkylene oxide is propylene oxide or butylene oxide forming a blend of aliphatic C16 to C18 propoxylated or butoxylated alcohols with each alcohol of the blend having 24 to 32 repeating units of propylene or butylene oxide.

In yet other approaches of the fuel additive composition, the weight average molecular weight of the blend may be about 1300 to about 2600; the blend of aliphatic C16 to C18 alkoxylated alcohols may include about 30 to about 70 weight percent of a linear or branched aliphatic C16 alkoxylated alcohol having 24 to 32 moles or repeating units of alkylene oxide and, in other approaches, also about 70 to about 30 weight percent of a linear or branched aliphatic C18 alkoxylated alcohol having 24 to 32 moles or repeating units of alkylene oxide; the blend of the at least one liquid carrier may further include about 6 weight percent or less of C20 or greater alkoxylated alcohols and/or about 4 percent or less of C14 or lower alkoxylated alcohols; the detergent may be selected from the group consisting of (i) Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; and (v) combinations thereof; the fuel additive composition may have a detergent to liquid carrier weight ratio from about 1:0.25 to about 1:1.5; the fuel additive composition may have a viscosity at about −20° F. of about 320 to about 400 cSt; the optional hydrocarbon solvent may be selected from the group consisting of toluene, xylene, tetrahydrofuran, isopropanol, isobutyl carbinol, n-butanol, naptha, and combinations thereof; the fuel additive composition may include about 0 to about 90 weight percent of the hydrocarbon solvent and have a detergent loading of about 10 to about 50 weight percent; and/or the blend of aliphatic C16 to C18 alkoxylated alcohols may have a viscosity of about 80 cSt to about 170 cSt at 40° C. It will be appreciated that any combination of the above features noted in this paragraph and the preceding paragraph may be combined in any combination within the fuel additive composition as needed for a particular application.

In another aspect, a fuel composition for spark-ignitable hydrocarbon fuels is described. In one approach of this aspect, the fuel composition includes a base fuel, detergent, optional hydrocarbon solvent, and at least one liquid carrier including a blend of aliphatic C16 to C18 alkoxylated alcohols with each alkoxylated alcohol of the blend having 24 to 32 moles or repeating units of alkylene oxide. In some approaches, the alkylene oxide of the liquid carrier is selected from the group consisting of ethylene oxide, propylene oxide, butylene oxide, copolymers thereof, and combinations thereof. In other approaches, the alkylene oxide is propylene oxide or butylene oxide forming a blend of aliphatic C16 to C18 propoxylated or butoxylated alcohols with each alcohol of the blend having 24 to 32 moles or repeating units of propylene or butylene oxide.

In other approaches of the fuel composition, the weight average molecular weight of the blend may be about 1300 to about 2600; the blend of aliphatic C16 to C18 alkoxylated alcohols may include about 30 to about 70 weight percent of a linear or branched aliphatic C16 alkoxylated alcohol having 24 to 32 moles or repeating units of alkylene oxide and, in other approaches, also about 70 to about 30 weight percent of a linear or branched aliphatic C18 alkoxylated alcohol having 24 to 32 moles or repeating units of alkylene oxide; the blend of the at least one liquid carrier may further include about 6 weight percent or less of C20 or greater alkoxylated alcohols and/or about 4 percent or less of C14 or lower alkoxylated alcohols; the detergent may be selected from the group consisting of (i) Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (iv) polyetheramines; and (v) combinations thereof; the fuel composition may include a detergent to liquid carrier weight ratio of about 1:0.25 to about 1:1.5; the optional hydrocarbon solvent may be selected from the group consisting of toluene, xylene, tetrahydrofuran, isopropanol, isobutyl carbinol, n-butanol, naptha, and combinations thereof; the fuel composition may include about 0 to about 90 weight percent of the hydrocarbon solvent and may have a detergent loading of about 10 to about 50 weight percent; and/or the blend of aliphatic C16 to C18 alkoxylated alcohols may have a viscosity of about 80 cSt to about 170 cSt at 40° C. It will be appreciated that any combination of the above features noted in this paragraph and the preceding paragraph may be combined in any combination within a fuel composition or additive as needed for a particular application.

In yet another aspect, a method for controlling intake valve deposits and intake valve stick is provided. In one approach, the method includes providing a fuel to a spark ignition internal combustion engine and operating the spark ignition internal combustion engine. The fuel contains a fuel additive composition with detergent; optional hydrocarbon solvent; and at least one liquid carrier including a blend of aliphatic C16 to C18 alkoxylated alcohols with each alkoxylated alcohol of the blend having 24 to 32 moles or repeating units of alkylene oxide. In some approaches, the alkylene oxide of the liquid carrier is selected form the group consisting of ethylene oxide, propylene oxide, butylene oxide, copolymers thereof, and combinations thereof. In other approaches, the alkylene oxide is propylene oxide or butylene oxide forming a blend of aliphatic C16 to C18 propoxylated or butoxylated alcohols with each alcohol of the blend having 24 to 32 moles or repeating units of propylene or butylene oxide.

In other approaches of the method, the weight average molecular weight of the blend may be about 1300 to about 2600; the blend of aliphatic C16 to C18 alkoxylated alcohols may include about 30 to about 70 weight percent of a linear or branched aliphatic C16 alkoxylated alcohol having 24 to 32 moles or repeating units of alkylene oxide and, in other approaches, also about 70 to about 30 weight percent of a linear or branched aliphatic C18 propoxylated alcohol having 24 to 32 moles or repeating units of alkylene oxide; the blend of the at least one liquid carrier may further include about 6 weight percent or less of C20 or greater alkoxylated alcohols and/or about 4 percent or less of C14 or lower alkoxylated alcohols; the detergent may be selected from the group consisting of (i) Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof, (vi) polyetheramines, and (v) combinations thereof; the fuel additive composition may have a detergent to liquid carrier weight ratio of about 1:0.25 to about 1:1.5; the fuel additive composition may have a viscosity at about −20° F. of about 320 to about 400 cSt; the optional hydrocarbon solvent may be selected from the group consisting of toluene, xylene, tetrahydrofuran, isopropanol, isobutyl carbinol, n-butanol, naptha, and combinations thereof; and/or the fuel additive composition may include about 0 to about 90 weight percent of the hydrocarbon solvent and a detergent loading of about 10 to about 50 weight percent. It will be appreciated that any combination of the above features noted in this paragraph and the preceding paragraph may be combined in any combination within a fuel composition or additive as needed for a particular application and method.

In yet another aspect, a method is provided to decrease the amount of solvent used in a fuel performance additive or fuel including such additive. In one approach, the method includes forming a fuel performance additive by combining a detergent, a reduced amount of hydrocarbon solvent, and at least one liquid carrier including a blend of aliphatic C16 to C18 alkoxylated alcohols with each alkoxylated alcohol of the blend having 24 to 32 moles or repeating units of alkylene oxide. In some approaches, the alkylene oxide is selected form the group consisting of ethylene oxide, propylene oxide, butylene oxide, copolymers thereof, and combinations thereof. In other approaches, the alkylene oxide is propylene oxide or butylene oxide forming a blend of aliphatic C16 to C18 propoxylated or butoxylated alcohols with each alcohol of the blend having 24 to 32 moles or repeating units of propylene or butylene oxide. In some approaches, the amount of hydrocarbon solvent is reduced about 1 to about 5 weight percent as compared to a fuel performance additive not including the blend of aliphatic C16 to C18 alkoxylated alcohols and providing similar intake valve deposits and intake valve stick. Methods to decrease the amount of solvent in a fuel performance additive may include any of the other approaches and aspects as noted in the previous paragraphs.

In yet another aspect, a fuel additive composition is described herein suitable for spark-ignitable fuels consisting essentially of detergent, optional supplemental fuel additives, at least one liquid carrier including a blend of aliphatic C16 to C18 alkoxylated alcohols with each alkoxylated alcohol of the blend having 24 to 32 moles or repeating units of alkylene oxide, and wherein the fuel additive composition is essentially free of hydrocarbon solvent (such as, less than about 2 weight percent, in other approaches, less than about 1 weight percent, and in yet other approaches, no solvent). In some approaches, the alkylene oxide is selected form the group consisting of ethylene oxide, propylene oxide, butylene oxide, copolymers thereof, and combinations thereof. In other approaches, the alkylene oxide is propylene or butylene oxide forming a blend of aliphatic C16 to C18 propoxylated or butoxylated alcohols with each alcohol of the blend having 24 to 32 moles or repeating units of propylene or butylene oxide. The optional supplemental fuel additives may include additional carrier oils, dispersants/detergents, antioxidants, metal deactivators, dyes, markers, corrosion inhibitors, biocides, antistatic additives, drag reducing agents, demulsifiers, dehazers, anti-icing additives, antiknock additives, anti-valve-seat recession additives, anti-wear additives, cold flow improvers, pour point depressants, lubricity additives, friction improving additives, fuel economy additives, octane improvers, cetane improvers, combustion improvers and other similar additives along with other additives found in gasoline or that may carry over from processing, storing or distributing the fuel.

BRIEF DESCRIPTION OF THE DRAWING FIGURES

Figure 3:
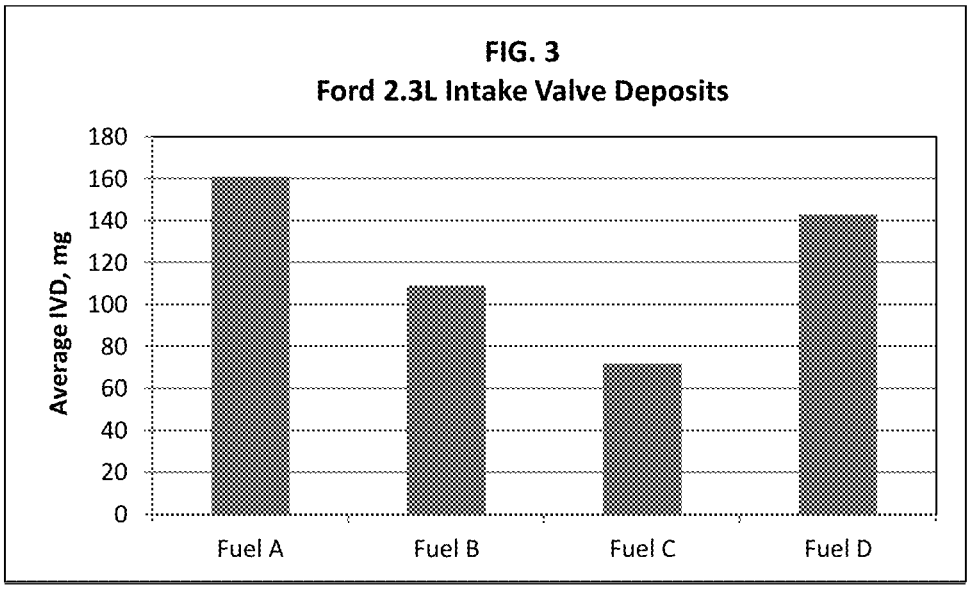
Figure 4:
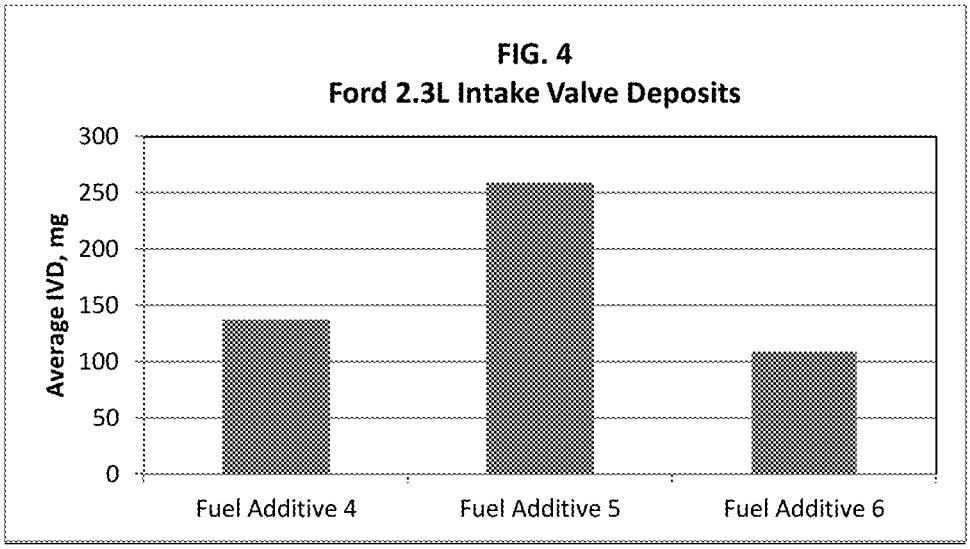
Figure 5:
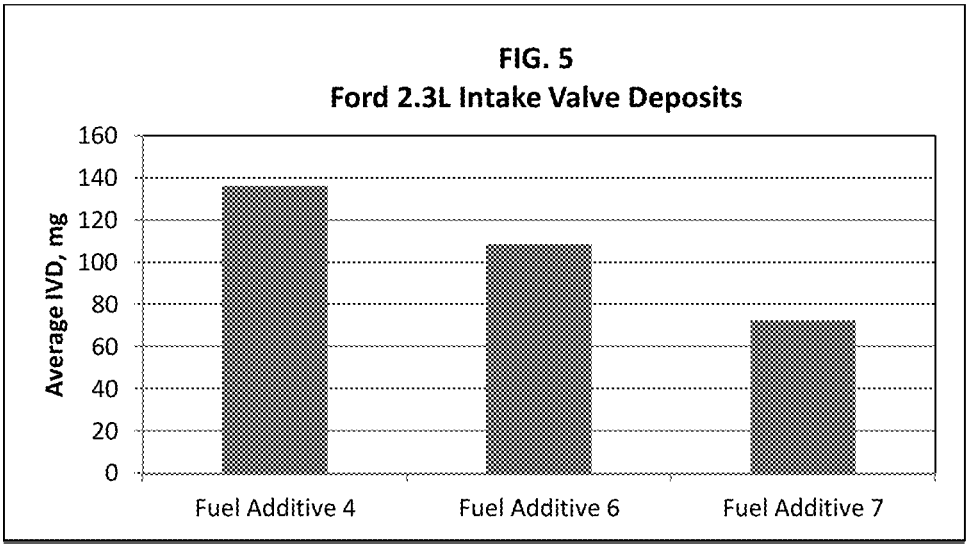
Figure 6:
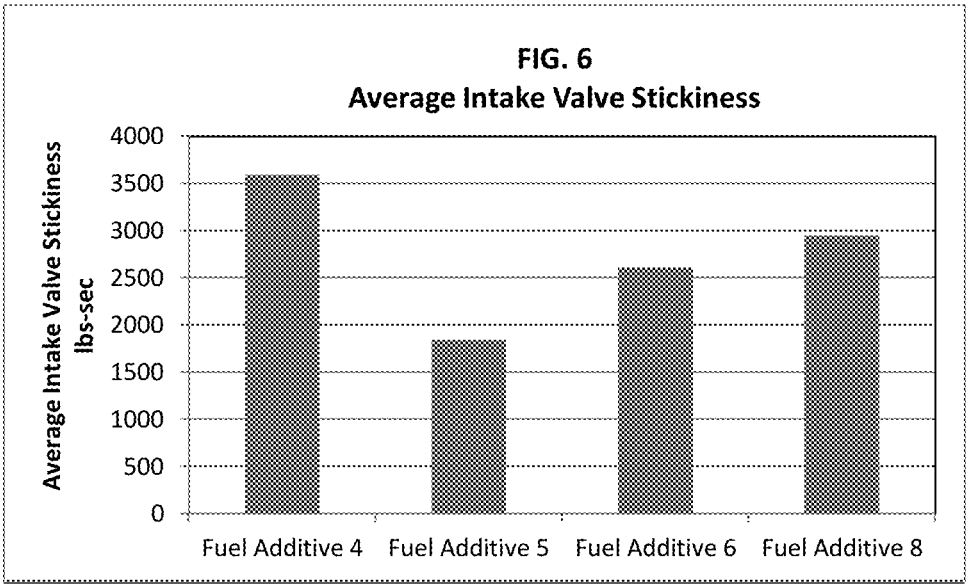
Figure 7:
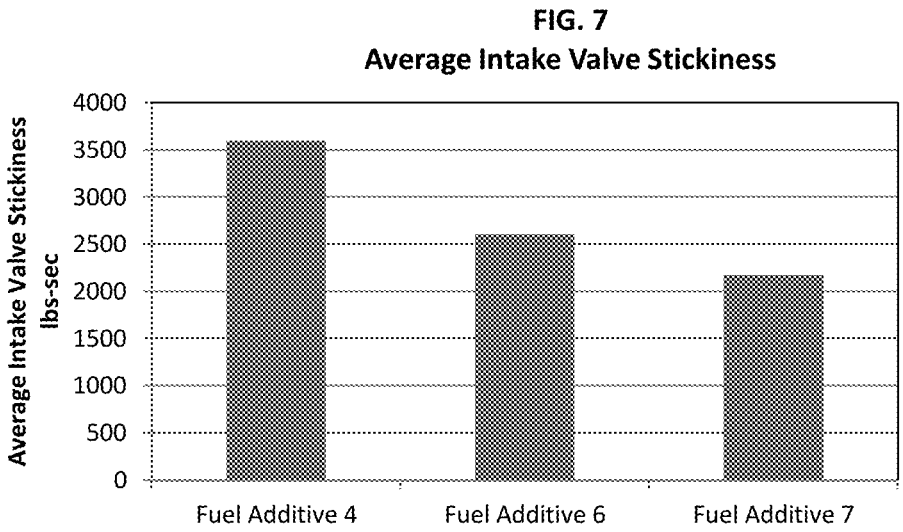
Figure 8:
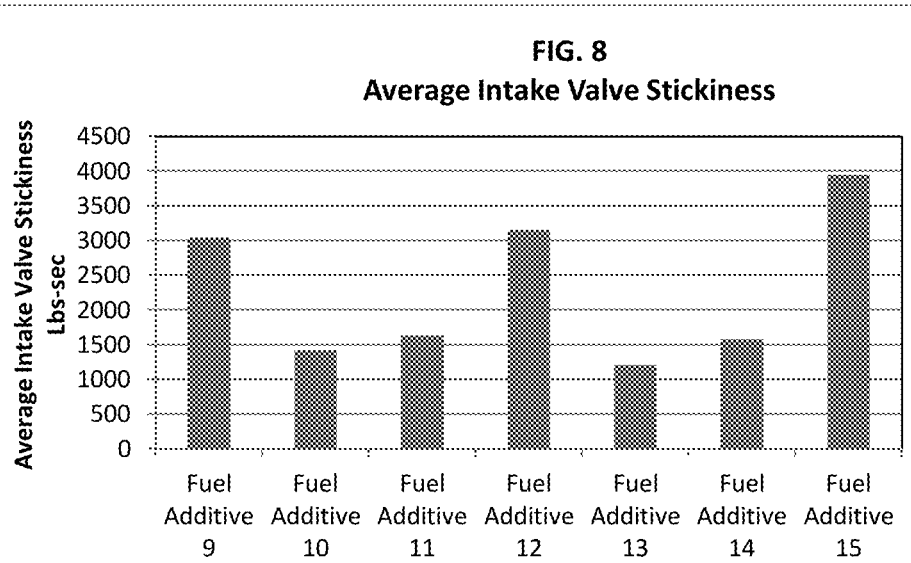
Figure 9:
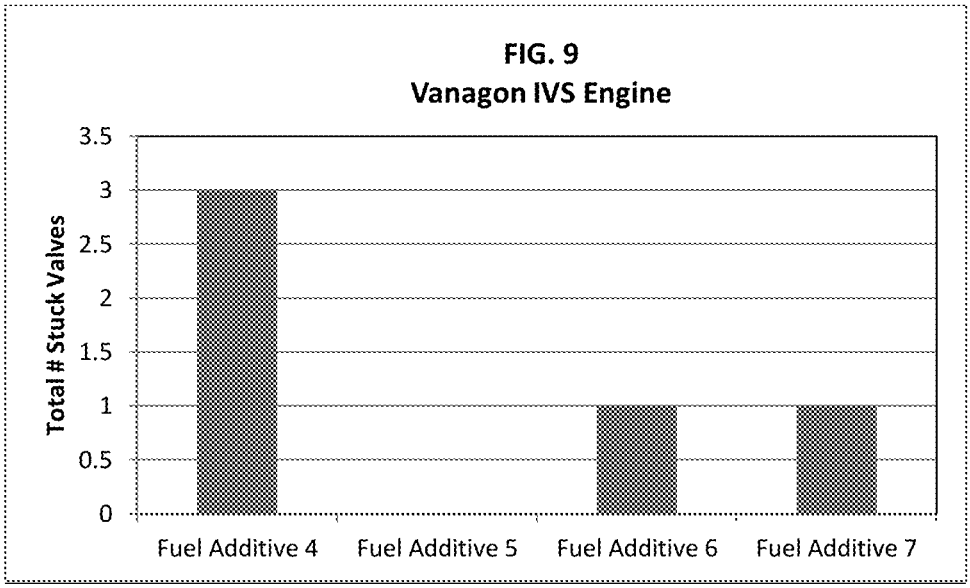

FIGS. 3, 4, and 5 are graphs showing intake valve deposits of various fuels including fuel additives;

FIGS. 6, 7, and 8 are graphs showing intake valve sticking of fuel additives; and FIG. 9 is a graph showing intake valve sticking of various fuels including fuel additives.

DETAILED DESCRIPTION

A carrier fluid or fluidizer for use in fuel performance additives or fuels including such additives is described herein. The novel carrier fluids include a unique blend of alkoxylated alcohols or polyols providing unexpected performance improvements to fuel performance additives and fuels incorporating the additives. The carrier fluids, when combined with at least a detergent, provide desired valve stick performance and unexpectedly improve the intake valve deposit performance at the same time. In some approaches, the unique carrier fluids also exhibit a reduced viscosity that enables a reduction in total hydrocarbon solvent loading of the fuel additive leading to improved performance and/or enabling lower treat rates for the fuel provider.

A carrier fluid or fluidizer is generally a material that aids in the dispersal of an additive(s), such as a detergent, for fuel into a fuel by either suspension or dissolution of the additive(s). A carrier fluid may also be a fluid that generally provides a fluidizing property to the fuel or an ability to carry or transport additive(s) within the fuel, and/or provide functionality beyond mere dilution. In this disclosure, the carrier fluid may be the unique alcohol or polyol blends as described herein as well as such blends combined with optional secondary carrier fluids such as, but not limited to, poly-alpha-olefin oligomers and monomers, mineral oils, liquid poly(oxyalkylene) compounds, other liquid alcohols or polyols, polyalkenes, liquid esters, combinations thereof, and similar liquid or fluid carriers.

In a first aspect, a fuel performance additive or composition suitable for spark-ignitable fuels is described herein. The composition includes a detergent; an optional hydrocarbon solvent; and at least one liquid carrier including a blend of aliphatic C16 to C18 alkoxylated alcohols with each alkoxylated alcohol of the blend having 24 to 32 moles or repeating units of alkylene oxide. The aliphatic C16 to C18 aliphatic chains may be linear or branched and, in some preferred approaches, such chains are linear. The unique liquid carrier blend controls intake valve sticking (IVS) and unexpectedly controls intake valve deposits (IVD) at the same time. As used herein, control or controls with respect to IVS or IVD generally means reducing or preventing valve sticking or reducing or preventing the formation of valve deposits. Control or controls may also generally mean the removal of or reduction of any existing valve deposits. As discussed in the background, carrier fluids were not expected to exhibit such a dramatic increase in IVD performance as discovered for the unique blended fluids described herein.

Carrier Fluid

Turning to more specifics, the novel carrier fluid is a blend of aliphatic C16 and C18 alkoxylated alcohols with selected amounts of alkylene oxides therein to achieve the desired performance improvements. By one approach, the alcohols are blends of C16 and C18 hydrocarbyl-terminated or hydrocarbyl-capped poly(oxyalkylene) polymers. The hydrocarbyl moieties are preferably aliphatic chains and may be linear or branched, and preferably are linear. In one approach, the blend of aliphatic alkoxylated alcohols may have the structural formula exemplified below:

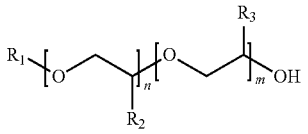

wherein R1 is an aliphatic, linear or branched, preferably saturated C16 or C18 hydrocarbon chain, R2 and R3 are independently hydrogen or an alkyl hydrocarbon chain having 1 or 2 carbons, and may be either the same or different, and n+m may be from 24 to 32.

More specifically, the blends of alkoxylated alcohols of the carrier fluids herein include lower alkylene oxides selected from the group consisting of ethylene oxide, propylene oxide, butylene oxide, copolymers thereof, and combinations thereof. Preferably, the lower alkylene oxides are propylene oxide or butylene oxide or copolymers of ethylene oxide, propylene oxide, and butylene oxide (as well as any combinations thereof). In another approach, the alkylene oxides are propylene oxide. The copolymers may be random or block copolymers. In one approach, the alkoxylated alcohols are blends of linear or branched aliphatic C16 and C18 alkoxylated alcohols each having 24 to 32 moles or repeating units of alkylene oxide therein, and in another approach, each alcohol has about 28 to about 32 moles or repeating units of the alkylene oxide.

The blend of the linear or branched aliphatic C16 alkoxylated alcohols and the linear or branched aliphatic C18 alkoxylated alcohols may have a weight average molecular weight of about 1300 to about 2600 and, in other approaches, about 1600 to about 2200. Above and below the selected mole and molecular weight ranges of the carrier fluid blends there is a noticeable drop off in performance as provided in the Examples below.

The blend of aliphatic C16 to C18 alkoxylated alcohols may include about 30 to about 70 weight percent (in another approach, about 30 to about 50 weight percent) of an aliphatic C16 alkoxylated alcohol having 24 to 32 moles or repeating units of alkoxylene oxide and about 70 to about 30 weight percent (in another approach, about 50 to about 70 weight percent) of an aliphatic C18 alkoxylated alcohol having 24 to 32 moles or repeating units of alkoxylene oxide. In some approaches, the blend of alkoxylated alcohols includes about 2 to about 4 times more of the C18 alkoxylated alcohol relative to the C16 alkoxylated alcohol, and in other approaches, about 2.3 to about 3 times more of the C18 alcohol.

Lower and higher molecular weight alcohols lead to decreased performance. Thus, the blends herein may also include about 6 percent or less (in other approaches, about 4 percent or less, and in yet other approaches, about 2 percent or less) of C20 or greater alkoxylated alcohols and/or about 4 weight percent or less (in or other approaches about 2 weight percent or less, and in yet other approaches, about 1 percent or less) of C14 or lower alkoxylated alcohols.

The hydrocarbyl-capped poly(oxyalkylene) polymers employed in the present disclosure are C16 or C18 capped monohydroxy compounds, i.e., alcohols and are to be distinguished from the poly(oxyalkylene) alcohols that are glycols (diols), or polyols, which are not hydrocarbyl-capped or capped with hydrocarbon chains other than predominately C16 or C18 chains. The hydrocarbyl-capped poly(oxyalkylene) alcohols may be produced by the addition of lower alkylene oxides, such as ethylene oxide, propylene oxide, or the butylene oxides to the hydroxy compound R—OH (that is, a starter alcohol) under polymerization conditions, wherein R is the hydrocarbyl group having either 16 or 18 carbon chains and which caps the poly(oxyalkylene) chain.

In one approach, the blend of aliphatic C16 to C18 alkoxylated alcohols of the carrier fluids herein are synthetic blends in that the blend is specifically formulated to include the select amounts or ratios of C16 and C18 alcohols rather than a neat or single alcohol such as a single stearyl or cetyl alcohol individually. When combined, the blends of alcohols herein exhibit a viscosity of about 80 cSt to about 170 cSt at 40° C. as measured by ASTM D445. When combined in a fuel performance additive composition, the whole fuel additive composition may have a viscosity at −20° F. of about 320 cSt to about 400 cSt, but as discussed more below, this functional viscosity can be achieved with a reduction in solvent adds to the composition.

The blend of alkoxylated alcohols can be prepared by any starter alcohol that provides the desired C16 and C18 polyol distribution. By one approach, the alkoxylated alcohol blends can be prepared by reacting a saturated linear or branched alcohol with the desired hydrocarbon blend of C16 to C18 hydrocarbons with the selected alkylene oxide and a double metal or basic catalyst.

In other approaches, in the polymerization reaction a single type of alkylene oxide may be employed, e.g., propylene oxide, in which case the product is a homopolymer, e.g., a poly(oxyalkylene) propanol. However, copolymers are equally satisfactory and random or block copolymers are readily prepared by contacting the hydroxyl-containing compound with a mixture of alkylene oxides, such as a mixture of ethylene, propylene, and/or butylene oxides. Random polymers are more easily prepared when the reactivities of the oxides are relatively equal. In certain cases, when ethylene oxides is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. In one example, a particular block copolymer may be represented by a polymer prepared by polymerizing propylene oxide on a suitable monohydroxy compound to form a poly(oxypropylene) alcohol and then polymerizing butylene oxide on the poly (oxyalkylene) alcohol.

Detergents

Various types of detergents singularly, or in combination, are suitable for use in the present disclosure. For instance, the detergent or dispersants for the fuel performance additive and fuels herein may be selected from (i) Mannich reaction products formed by condensing a long chain aliphatic hydrocarbon-substituted phenol or cresol with an aldehyde, and an amine, (ii) long chain aliphatic hydrocarbons having an amine or a polyamine attached thereto, (iii) fuel-soluble nitrogen containing salts, amides, imides, succinimides, imidazolines, esters, and long chain aliphatic hydrocarbon-substituted dicarboxylic acids or their anhydrides or mixtures thereof; (vi) polyetheramines; and (v) various combinations thereof. In the fuel additives or fuels of the present disclosure, the detergent can be at least one member selected from the group consisting of polyamines, polyetheramines, succinimides, succinamides, aliphatic polyamines, and Mannich detergents.

The fuel additives and fuels herein may include a weight ratio of detergent to carrier fluid of about 1:0.25 to about 1:1.5, and in other approaches, about 1:0.5 to about 1:0.8.

Suitable Mannich base detergents useful in the disclosure are the reaction products of an alkyl-substituted hydroxy aromatic compound, an aldehyde and an amine. The alkyl-substituted hydroxyaromatic compound, aldehyde and amine used in making the Mannich detergent reaction products described herein may be any such compounds known and applied in the art.

Representative alkyl-substituted hydroxyaromatic compounds that may be used in forming the Mannich base reaction products are polypropylphenol (formed by alkylating a phenol with polypropylene), polybutylphenols (formed by alkylating a phenol with polybutenes and/or polyisobutylene), and polybutyl-co-polypropylphenols (formed by alkylating phenol with a copolymer of butylene and/or butylene and propylene). Other similar long-chain alkylphenols may also be used. Examples include phenols alkylated with copolymers of butylene and/or isobutylene and/or propylene, and one or more mono-olefinic co-monomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene, butylenes and/or isobutylene may be aliphatic and may also contain non-aliphatic groups, e.g., styrene, o-methylstyrene, p-methylstyrene, divinyl benzene and the like. Thus in any case the resulting polymers and copolymers used in forming the alkyl-substituted hydroxyaromatic compounds are substantially aliphatic hydrocarbon polymers.

In one approach herein, polybutylphenol (formed by alkylating a phenol with polybutylene) is used in forming the Mannich base detergents. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polybutylenes having relatively high proportions of polymer molecules having a terminal vinylidene group, formed by methods such as described, for example, in U.S. Pat. No. 4,152,499 and W. German Offenlegungsschrift 29 04 314, are also suitable for use in forming the long chain alkylated phenol reactant.

The alkylation of the hydroxyaromatic compound is typically performed in the presence of an alkylating catalyst at a temperature in the range of about 20° to about 200° C. Acidic catalysts are generally used to promote Friedel-Crafts alkylation. Typical catalysts used in commercial production include sulfuric acid, $BF_3$, aluminum phenoxide, methanesulphonic acid, cationic exchange resin, acidic clays and modified zeolites.

The long chain alkyl substituents on the benzene ring of the phenolic compound are derived from polyolefin having a number average molecular weight (MW of from about 500 to about 3000 Daltons (preferably from about 500 to about 2100 Daltons) as determined by gel permeation chromatography (GPC). It is also desirable that the polyolefin used have a polydispersity (weight average molecular weight/number average molecular weight) in the range of about 1 to about 4 (more suitably from about 1 to about 2) as determined by GPC.

The chromatographic conditions for the GPC method referred to throughout the specification are as follows: 20 μL of sample having a concentration of approximately 5 mg/mL (polymer/unstabilized tetrahydrofuran solvent) is injected into 1000 Å, 500 Å and 100 Å columns at a flow rate of 1.0 mL/min. The run time is 40 minutes. A Differential Refractive Index detector is used and calibration is made relative to polyisobutene standards having a molecular weight range of 284 to 4080 Daltons.

The Mannich detergents may be made from a long chain alkylphenol. However, other phenolic compounds may be used including high molecular weight alkyl-substituted derivatives of resorcinol, hydroquinone, catechol, hydroxydiphenyl, benzylphenol, phenethylphenol, naphthol, tolylnaphthol, among others. Particularly suitable for the preparation of the Mannich condensation products are the polyalkylphenol and polyalkylcresol reactants, e.g., polypropylphenol, polybutylphenol, polyisobutylphenol, polypropylcresol, polyisobutylcresol, and polybutylcresol, wherein the alkyl group has a number average molecular weight of about 500 to about 2100, while the most suitable alkyl group is a polyisobutyl group derived from polyisobutylene having a number average molecular weight in the range of about 800 to about 1300 Daltons.

The configuration of the alkyl-substituted hydroxyaromatic compound is that of a para-substituted mono-alkylphenol or a para-substituted mono-alkyl ortho-cresol. However, any alkylphenol readily reactive in the Mannich condensation reaction may be used. Thus, Mannich products made from alkylphenols having only one ring alkyl substituent, or two or more ring alkyl substituents are suitable for use in making the Mannich base detergents described herein. The long chain alkyl substituents may contain some residual unsaturation, but in general, are substantially saturated alkyl groups. Long chain alkyl phenols, according to the disclosure, include cresol.

Representative amine reactants include, but are not limited to, linear, branched or cyclic alkylene monoamines and di- or polyamines having at least one suitably reactive primary or secondary amino group in the molecule. Other substituents such as hydroxyl, cyano, amido, etc., may be present in the amine compound. In one embodiment, the Mannich base detergent is derived from an alkylene di- or polyamine. Such di- or polyamines may include, but are not limited to, polyethylene polyamines, such as ethylenediamine, diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine and mixtures of such amines having nitrogen contents corresponding to alkylene polyamines of the formula $H_2N$-(A-NH—)$_n$H, where A is divalent ethylene and n is an integer of from 1 to 10. The alkylene polyamines may be obtained by the reaction of ammonia and dihaloalkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbon atoms are suitable alkylene polyamine reactants.

In one embodiment, the Mannich base detergent is derived from an aliphatic linear, branched or cyclic diamine or polyamine having one primary or secondary amino group and one tertiary amino group in the molecule. Examples of suitable polyamines include N,N,N",N"-tetraalkyl-dialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N, N',N", N'"-pentaalkyltrialkylene-tetramines (one terminal tertiary amino group, two internal tertiary amino groups and one terminal secondary amino group), N,N-dihydroxyalkyl-alpha, omega-alkylenediamines (one terminal tertiary amino group and one terminal primary amino group), N,N,N'-trihydroxy-alkyl-alpha, omega-alkylenediamines (one terminal tertiary amino group and one terminal secondary amino group), tris(dialkylaminoalkyl)aminoalkylmethanes (three terminal tertiary amino groups and one terminal primary amino group), and like compounds, wherein the alkyl groups are the same or different and typically contain no more than about 12 carbon atoms each, and which suitably contain from 1 to 4 carbon atoms each. In one embodiment, the alkyl groups of the polyamine are methyl and/or ethyl groups. Accordingly, the polyamine reactants may be selected from N,N-dialkyl-alpha, omega-alkylenediamine, such as those having from 3 to about 6 carbon atoms in the alkylene group and from 1 to about 12 carbon atoms in each of the alkyl groups. A particularly useful polyamine is N,N-dimethyl-1,3-propanediamine and N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propanediamine, N-(tert-butyl)-1-methyl-1,2-ethanediamine, N-(tert-butyl)-1-methyl-1,3-propanediamine, and 3,5-di(tert-butyl)aminoethy-1-piperazine.

Representative aldehydes for use in the preparation of the Mannich base products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. A particularly suitable aldehyde may be selected from formaldehyde and formalin.

The condensation reaction among the alkylphenol, the specified amine(s) and the aldehyde may be conducted at a temperature in the range of about 40° to about 200° C. The reaction may be conducted in bulk (no diluent or solvent) or in a solvent or diluent. Water is evolved and may be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively.

Suitable Mannich base detergents for use in the disclosed embodiments include those detergents taught in U.S. Pat. Nos. 4,231,759; 5,514,190; 5,634,951; 5,697,988; 5,725,612; 5,876,468; and 6,800,103, the disclosures of which are incorporated herein by reference.

The succinimide detergent suitable for use in various embodiments of the disclosure may impart a dispersant effect on the fuel composition when added in an amount effective for that purpose.

The succinimide detergents, for example, include alkenyl succinimides comprising the reaction products obtained by reacting an alkenyl succinic anhydride, acid, acid-ester or lower alkyl ester with an amine containing at least one primary amine group. Representative non-limiting examples are given in U.S. Pat. Nos. 3,172,892; 3,202,678; 3,219,666; 3,272,746; 3,254,025; 3,216,936; 4,234,435; and 5,575,823. The alkenyl succinic anhydride may be prepared readily by heating a mixture of olefin and maleic anhydride to about 180-220° C. The olefin is, in an embodiment, a polymer or copolymer of a lower monoolefin such as ethylene, propylene, isobutene and the like. In another embodiment the source of alkenyl group is from polyisobutene having a molecular weight up to 10,000 Daltons or higher. In another embodiment the alkenyl is a polyisobutene group having a molecular weight of about 500-5,000 Daltons and typically about 700-2,000 Daltons. In a preferred embodiment, the succinimide is derived from tetraethylene pentamine (TEPA) and polyisobutylene succinic anhydride (PIBSA) in a 1:1 molar ratio, wherein the PIB is about 950 molecular weight.

Amines which may be used to make the succinimide detergents include any that have at least one primary amine group which can react to form an imide group. A few representative examples are: methylamine, 2-ethylhexylamine, n-dodecylamine, stearylamine, N,N-dimethyl-propanediamine, N-(3-aminopropyl)morpholine, N-dodecyl propanediamine, N-aminopropyl piperazine ethanolamine, N-ethanol ethylene diamine and the like. Particularly suitable amines include the alkylene polyamines such as propylene diamine, dipropylene triamine, di-(1,2-butylene)-triamine, tetra-(1,2-propylene)pentamine and TEPA.

In one embodiment the amines are the ethylene polyamines that have the formula $H_2N(CH_2CH_2NH)_nH$ wherein n is an integer from one to ten. These ethylene polyamines include ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end so can form mono-alkenylsuccinimides and bis-alkenylsuccinimides.

The succinimide detergents for use in the disclosed embodiments also include the products of reaction of a polyethylenepolyamine, e.g. triethylene tetramine or tetraethylene pentamine, with a hydrocarbon substituted carboxylic acid, diacid, or anhydride made by reaction of a polyolefin, such as polyisobutene, having a molecular weight of 500 to 5,000 Daltons, especially 700 to 2000 Daltons, with an unsaturated polycarboxylic acid, diacid, or anhydride, e.g. maleic anhydride.

Also suitable for use as the succinimide detergents of the disclosed embodiments are succinimide-amides prepared by reacting a succinimide-acid with a polyamine or partially alkoxylated polyamine, as taught in U.S. Pat. No. 6,548,458. The succinimide-acid compounds may be prepared by reacting an alpha-omega amino acid with an alkenyl or alkyl-substituted succinic anhydride in a suitable reaction media. Suitable reaction media include, but are not limited to, an organic solvent, such as toluene, or process oil. Water is a by-product of this reaction. The use of toluene allows for azeotropic removal of water.

The mole ratio of maleic anhydride to olefin in the reaction mixture used to make the succinimide detergents can vary widely. In one example, the mole ratio of maleic anhydride to olefin is from 5:1 to 1:5, and in another example the range is from 3:1 to 1:3 and in yet another embodiment the maleic anhydride is used in stoichiometric excess, e.g. 1.1 to 5 moles maleic anhydride per mole of olefin. The unreacted maleic anhydride can be vaporized from the resultant reaction mixture.

The alkyl or alkenyl-substituted succinic anhydrides may be prepared by the reaction of maleic anhydride with the desired polyolefin or chlorinated polyolefin, under reaction conditions well known in the art. For example, such succinic anhydrides may be prepared by the thermal reaction of a polyolefin and maleic anhydride, as described, for example in U.S. Pat. Nos. 3,361,673 and 3,676,089. Alternatively, the substituted succinic anhydrides may be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S. Pat. Nos. 4,234,435; 5,620,486 and 5,393,309.

Polyalkenyl succinic anhydrides may be converted to polyalkyl succinic anhydrides by using conventional reducing conditions such as catalytic hydrogenation. For catalytic hydrogenation, a preferred catalyst is palladium on carbon. Likewise, polyalkenyl succinimides may be converted to polyalkyl succinimides using similar reducing conditions.

The polyalkyl or polyalkenyl substituent on the succinic anhydrides used to make the succinimide detergents may be derived from polyolefins which are polymers or copolymers of mono-olefins, particularly 1-mono-olefins, such as ethylene, propylene, butylene, and the like. When used, the mono-olefin will have 2 to about 24 carbon atoms, and typically, about 3 to 12 carbon atoms. Also, the mono-olefins may include propylene, butylene, particularly isobutylene, 1-octene and 1-decene. Polyolefins prepared from such mono-olefins include polypropylene, polybutene, polyisobutene, and the polyalphaolefins produced from 1-octene and 1-decene.

In one embodiment the polyalkyl or polyalkenyl substituent is one derived from polyisobutene. Suitable polyisobutenes for use in preparing the succinimide-acids of the present invention include those polyisobutenes that comprise at least about 20% of the more reactive methylvinylidene isomer, for example, at least 50% and desirably at least 70% reactive methylvinylidene isomer. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. The amount of succinimide detergent used in the fuel compositions described herein may have a weight ratio of succinimide detergent to Mannich base detergent mixture ranging from about 1:6 to about 1:12, for example, from about 1:9 to about 1:11 succinimide detergent to Mannich base detergent mixture.

Hydrocarbon Solvent

The fuel additive compositions and the fuels herein may include an optional hydrocarbon solvent as needed to achieve to a desired viscosity of the fuel additive. Suitable hydrocarbon solvents may be toluene, xylene, tetrahydrofuran, isopropanol, isobutyl carbinol, n-butanol, naptha, and combinations thereof. As noted above, the carrier fluids with the unique blend of alcohols herein exhibits a decreased viscosity as compared to prior carrier fluids. Thus, in some approaches, it is advantageous that the fuel additives compositions may include a decreased level of solvent in order to function as a carrier fluid.

To this end, the fuel performance additive compositions of the present disclosure may include about 0 to about 90 weight percent of the hydrocarbon solvent, in other approaches, about 10 to about 70 weight percent of the hydrocarbon solvent, and in yet further approaches, about 20 to about 50 weight percent of the hydrocarbon solvent. The reduced levels of solvent may lead (in some applications) to a relative higher percentage of detergent in the fuel performance additive relative to other additive components. In some approaches, the additives described herein may exhibit a detergent loading of about 10 weight percent to about 50 weight percent and, in other approaches, about 15 to about 40 weight percent.

Optional Additives

The fuel performance additives and fuel compositions of the present disclosure may contain supplemental additives in addition to the detergent(s) and carrier fluids described above. Said supplemental additives include additional dispersants/detergents, antioxidants, carrier fluids, metal deactivators, dyes, markers, corrosion inhibitors, biocides, antistatic additives, drag reducing agents, demulsifiers, dehazers, anti-icing additives, antiknock additives, anti-valve-seat recession additives, anti-wear additives, lubricity additives and combustion improvers.

The additives used in formulating the fuel compositions according to the disclosure may be blended into the base fuel individually or in various sub-combinations. However, it is desirable to blend all of the components concurrently using an additive concentrate as this takes advantage of the mutual compatibility afforded by the combination of ingredients when in the form of an additive concentrate. Also use of a concentrate reduces blending time and lessens the possibility of blending errors.

Base Fuel

The base fuels used in formulating the fuel compositions of the disclosed embodiments include any base fuels suitable for use in the operation of spark-ignition internal combustion engines such as leaded or unleaded motor and aviation gasoline, and so-called reformulated gasoline which typically contain both hydrocarbons of the gasoline boiling range and fuel-soluble oxygenated blending agents ("oxygenates"), such as alcohols, ethers and other suitable oxygen-containing organic compounds. For example, the fuel may include a mixture of hydrocarbons boiling in the gasoline boiling range. Such fuel may consist of straight chain or branch chain paraffins, cycloparaffins, olefins, aromatic hydrocarbons or any mixture of thereof. The gasoline may be derived from straight run naptha, polymer gasoline, natural gasoline or from catalytically reformed stocks boiling in the range from about 27° to about 230° C. The octane level of the gasoline is not critical and any conventional gasoline may be used in embodiments of the disclosure.

The fuel may also contain oxygenates. Oxygenates suitable for use in the disclosed embodiments include methanol, ethanol, isopropanol, t-butanol, n-butanol, bio-butanol, mixed $C_1$ to $C_5$ alcohols, methyl tertiary butyl ether, tertiary amyl methylether, ethyl tertiary butyl ether and mixed ethers. Oxygenates, when used, will normally be present in the base fuel in an amount below about 85% by volume, and preferably in an amount that provides an oxygen content in the overall fuel in the range of about 0.5 to about 30 percent by volume, and in other approaches, about 0.5 to about 5 percent by volume.

In one embodiment, a mixture of hydrocarbons in the gasoline boiling range comprises a liquid hydrocarbon distillate fuel component, or mixture of such components, containing hydrocarbons which boil in the range from about 0° C. to about 250° C. (ASTM D86 or EN ISO 3405) or from about 20° C. or about 25° C. to about 200° C. or about 230° C. The optimal boiling ranges and distillation curves for such base fuels will typically vary according to the conditions of their intended use, for example the climate, the season and any applicable local regulatory standards or consumer preferences.

The hydrocarbon fuel component(s) may be obtained from any suitable source. They may for example be derived from petroleum, coal tar, natural gas or wood, in particular petroleum. Alternatively, they may be synthetic products such as from a Fischer-Tropsch synthesis. Conveniently, they may be derived in any known manner from straight-run gasoline, synthetically-produced aromatic hydrocarbon mixtures, thermally or catalytically cracked hydrocarbons, hydrocracked petroleum fractions, catalytically reformed hydrocarbons or mixtures of these.

In a preferred embodiment, the hydrocarbon fuel component(s) comprise components selected from one or more of the following groups: saturated hydrocarbons, olefinic hydrocarbons, aromatic hydrocarbons, and oxygenated hydrocarbons. In a particular embodiment, a mixture of hydrocarbons in the gasoline boiling range comprises a mixture of saturated hydrocarbons, olefinic hydrocarbons, aromatic hydrocarbons, and, optionally, oxygenated hydrocarbons. In a preferred embodiment, a mixture of hydrocarbons in the gasoline boiling range gasoline mixtures having a saturated hydrocarbon content ranging from about 40% to about 80% by volume, an olefinic hydrocarbon content from 0% to about 30% by volume and an aromatic hydrocarbon content from about 10% to about 60% by volume. In one embodiment, the base fuel is derived from straight run gasoline, polymer gasoline, natural gasoline, dimer and trimerized olefins, synthetically produced aromatic hydrocarbon mixtures, or from catalytically cracked or thermally cracked petroleum stocks, and mixtures of these. The hydrocarbon composition and octane level of the base fuel are not critical. In a specific embodiment, the octane level, (RON+MON)/2, will generally be above about 80. Any conventional motor fuel base may be used in embodiments of the present invention. For example, in certain embodiments, hydrocarbons in the gasoline may be replaced by up to a substantial amount of conventional alcohols or ethers, conventionally known for use in fuels. In one embodiment, the base fuels are desirably substantially free of water since water may impede smooth combustion.

The gasoline base fuel, or a mixture of hydrocarbons in the gasoline boiling range, represents a proportion of the fuel composition of embodiments of the invention. The term "major amount" is used herein because the amount of hydrocarbons in the gasoline boiling range is often about 50 weight or volume percent or more. The gasoline base fuel may be present in the gasoline composition from about 15% v/v or higher, more preferably about 50% v/v or greater. In one embodiment, the concentration may be up to about 15% v/v, or up to about 49% v/v. In another embodiment, the concentration may be up to about 60% v/v, up to about 65% v/v, up to about 70% v/v, up to about 80% v/v, or even up to about 90% v/v.

The United States gasoline specification for the hydrocarbon base fluid (a) in the gasoline composition which is preferred has the following physical properties and can be seen in Table 1.

TABLE 1

| US Gasoline Physical Properties | | | |
|---|---|---|---|
| Properties | Units | Min | Max |
| Vapor Pressure | psi | 6.4 | 15.0 |
| Distillation (° F./Evap) | vol % | | |
| | 10% | 122 | 158 |
| | 50% | 150 | 250 |
| | 90% | 210 | 365 |
| | EP | 230 | 437 |
| Drivability Index* | | 1050 | 1250 |

*DI = 1.5(T10) + 3.0 (T50) + 2.4 (ETOH vol %)

The gasoline specification D 4814 controls the volatility of gasoline by setting limits for the vapor pressure, distillation, drivability index and the fuels end point. The oxygenate amount in the fuel is less than 20 vol % is determined under ASTM D4815; however if the oxygenate amount is greater than 20 vol %, the method should be ASTM D5501.

The European Union gasoline specification for the hydrocarbon base fuel in the gasoline composition in which is preferred has the following physical properties which are shown in Table 2.

TABLE 2

| European Gasoline Specification | | | |
|---|---|---|---|
| Properties | Units | Min | Max |
| Vapor Pressure | Kpa | 45.0 | 90.0 |
| % Evap at | Vol % | | |
| 70° C. | | 20 | 50 |
| 100° C. | | 46 | 71 |
| 150° C. | | 75 | |
| FP | | | 210 |
| Distillation Residue | | | 2 |
| VLI ($10_{VPpsi}$ + 7 E70) | | 1050 | 1250 |

Hydrocarbons in the gasoline can be replaced by up to a substantial amount of conventional alcohols or ethers, conventionally known for use in fuels. The base fluids are desirably substantially free of water since water could impede a smooth combustion.

The hydrocarbon fuel mixture of an embodiment is substantially lead-free, but may contain minor amounts of blending agents such as methanol, ethanol, ethyl tertiary butyl ether, methyl tertiary butyl ether, tert-amyl methyl ether and the like, at from about 0.1% by volume to about 85% by volume of the base fuel, although larger amounts may be utilized. The gasoline composition according to the present teachings can further include embodiments wherein the fuel is a biofuel, such as, for example, ethanol and/or biobutanol.

In some embodiments of the fuel compositions herein, a fuel performance additive package or concentrate may include about 10 to about 50 weight percent of the detergents described herein (in other approaches, about 15 to about 40 weight percent, and in yet other approaches, about 20 to about 30 weight percent), about 2.5 to about 75 weight percent of the carrier fluids described herein (in other approaches, about 7.5 to about 45 weight percent, and in yet other approaches, about 12.5 to about 15 weight percent), about 0 to about 90 weight percent of the solvents described herein (in other approaches, about 10 to about 70 weight percent, and in yet other approaches, about 20 to about 50 weight percent), and about 0 to about 15 weight percent of other additives. In some approaches, base fuels may include about 10 to about 1000 parts per million (PPM) of the fuel additive package or concentrate so that the fuel composition when blended with the additive package can include from about 1 to about 500 PPM detergent, from about 0 to about 900 PPM solvent, and from about 0.25 to about 750 PPM carrier fluid as described herein. Ranges of the various components in the fuel performance additive package are shown below The present teachings relate to compositions having, and methods using, the blended C16 to C18 alkoxylated alcohols as described herein, as carriers for detergents and other additives in fuels. As such, the present disclosure is directed toward compositions, uses, systems, and methods incorporating these carrier fluids to reduce or eliminate fuel injector, valve and combustion chamber deposits among other benefits. More particularly, the disclosure relates to fuel performance additives and fuel compositions comprising a fuel, a carrier fluid, and a detergent, and the use of the fuel compositions in various internal combustion systems. By "combustion system" herein is meant, internal combustion engines, for example and not by limitation herein, Atkinson cycle engines, rotary engines, spray guided, wall guided, and the combined wall/spray guided direct injection gasoline ("DIG") engines, turbocharged DIG engines, supercharged DIG engines, homogeneous combustion DIG engines, homogeneous/stratified DIG engines, DIG engines outfitted with piezo injectors with capability of multiple fuel pulses per injection, DIG engines with EGR, DIG engines with a lean-NOx trap, DIG engines with a lean-NOx catalyst, DIG engines with SN-CR NOx control, DIG engines with exhaust diesel fuel after-injection (post combustion) for NOx control, DIG engines outfitted for flex fuel operation (for example, gasoline, ethanol, methanol, biofuels, synthetic fuels, natural gas, liquefied petroleum gas (LPG), and mixtures thereof.) Also included are conventional and advanced port-fueled internal combustion engines, with and without advanced exhaust after-treatment systems capability, with and without turbochargers, with and without superchargers, with and without combined supercharger/turbocharger, with and without on-board capability to deliver additive for combustion and emissions improvements, and with and without variable valve timing. Further included are gasoline fueled homogeneous charge compression ignition (HCCI) engines, diesel HCCI engines, two-stroke engines, diesel fuel engines, gasoline fuel engines, stationary generators, gasoline and diesel HCCI, supercharged, turbocharged, gasoline and diesel direct injection engines, engines capably of variable valve timing, leanburn engines, engines capable of inactivating cylinders or any other internal combustion engine, Still further examples of combustion systems include any of the above-listed systems combined in a hybrid vehicle with an electric motor.

The present disclosure also relates to methods for controlling, improving, or reducing intake valve deposits and, at the same time, controlling, improving, or reducing intake valve stick through selection of a specific carrier fluid. As used herein intake valve stick is determined by a laboratory-sized rig utilizing 8 intake valves and valve guides based on CEC F-16-T-96 and intake valve deposits are determine by ASTM D6201.

The method includes providing a fuel to a spark ignition internal combustion engine and operating the spark ignition internal combustion engine. The fuel contains a fuel additive composition with detergent, optional hydrocarbon solvent, and at least one liquid carrier including a blend of aliphatic C16 to C18 alkoxylated alcohols, which may be linear or branched, with each alkoxylated alcohol of the blend having 24 to 32 moles or repeating units of alkylene oxide as described above.

Also provided is a method of decreasing the amount of solvent used in a fuel performance additive or fuel including such additive. The method includes forming a fuel performance additive by combining a detergent, a reduced amount of hydrocarbon solvent, and at least one liquid carrier including a blend of aliphatic C16 to C18 alkoxylated alcohols with each alkoxylated alcohol of the blend having 26 to 32 moles or repeating units of alkylene oxide as described above. In one approach, the amount of hydrocarbon solvent is reduced about 1 to about 5 percent as compared to a fuel performance additive not including the blend of aliphatic C16 to C18 alkoxylated alcohols.

The practice and advantages of the disclosed embodiments may be demonstrated by the following examples, which are presented for purposes of illustration and not limitation. Unless indicated otherwise, all amounts, percentages, and ratios are by weight.

EXAMPLES

Example 1

Two inventive fuel additives were prepared including a blended carrier fluid of C16 to C18 propoxylated alcohols with either 24 or 28 moles or repeating units of propylene oxide to determine the viscosity improvement of such additives as compared to a comparative fuel performance additive with a conventional nonylphenolic alcohol carrier fluid reacted with 24 moles or repeating units of propylene oxide. The three evaluated fuel additives of this Example included the same components and amounts of those components with the only change being the type of carrier fluid.

Inventive fuel additive 1 included at least a detergent and a blended carrier fluid of approximately 70 weight percent C18 linear hydrocarbyl alcohol reacted with 24 moles or repeating units of propylene oxide and about 30 weight percent C16 linear hydrocarbyl alcohol reacted with 24 moles or repeating units of propylene oxide. Inventive fuel additive 2 was an identical fuel additive including at least a detergent and a blended carrier fluid except that the blended carrier fluid of this sample included approximately 70 weight percent C18 linear hydrocarbyl alcohol reacted with 28 moles or repeating units of propylene oxide and about 30 percent C16 linear hydrocarbyl alcohol reacted with 28 moles or repeating units of propylene oxide.

Figure 1:
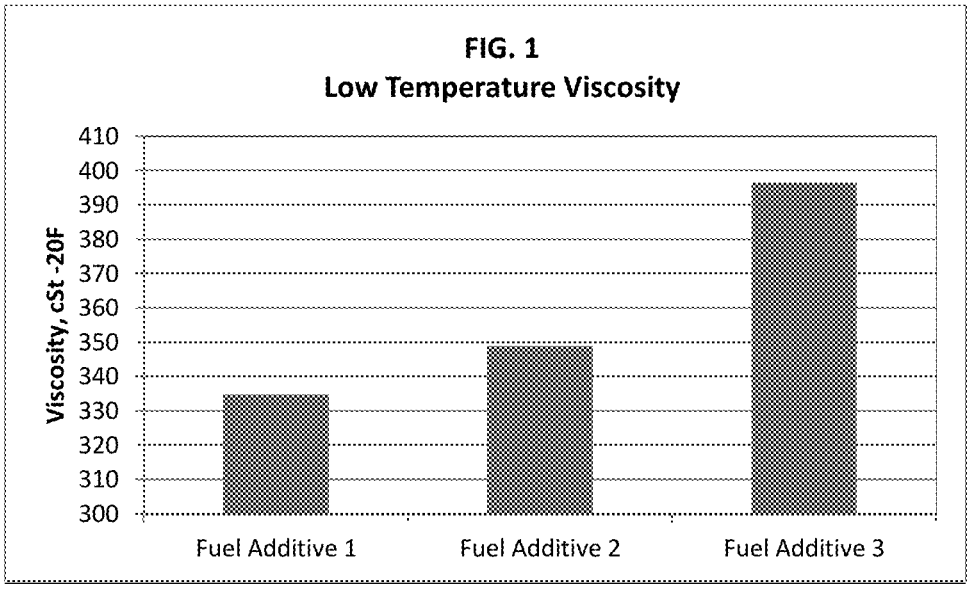
FIG. 1 is a graph showing viscosity of fuel additives.

Table 3 below and FIG. 1 show the decrease in viscosity of the fuel performance additives when using the inventive blended carrier fluids herein.

TABLE 3

| Sample | | Detergent | Starter Alcohol | Propylene Oxide (Moles or repeating units) | Viscosity, −20° F., cSt |
|---|---|---|---|---|---|
| Fuel Additive 1 | Inventive | Mannich | Alfol 1618CG | 24 | 334.89 |
| Fuel Additive 2 | Inventive | Mannich | Alfol 1618CG | 28 | 348.97 |
| Fuel Additive 3 | Comparative | Mannich | Nonylphenol | 24 | 396.45 |

Example 2

Figure 2:
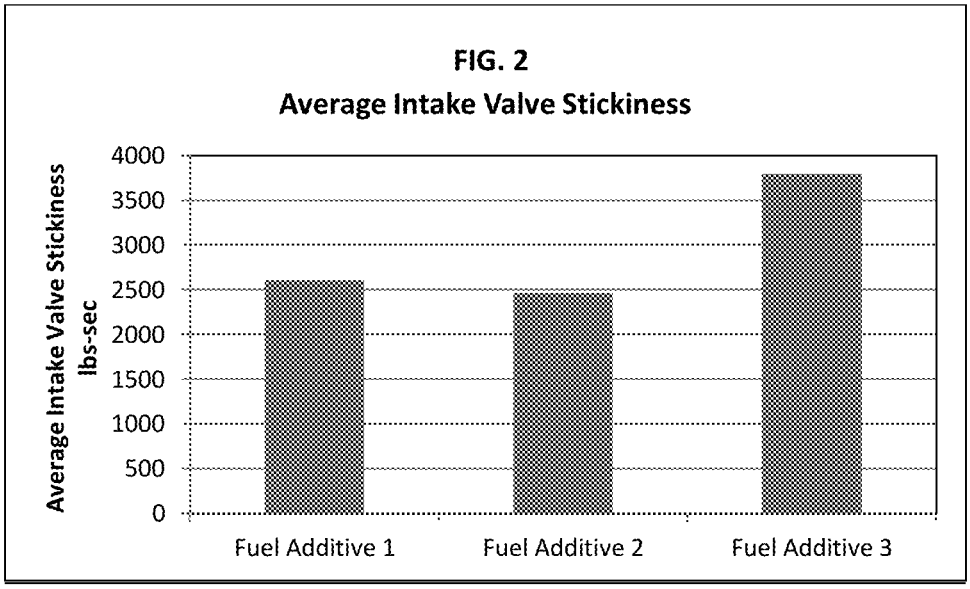
FIG. 2 is a graph showing intake valve sticking of fuel additives.

The same three fuel additives of Example 1 were further tested for intake valve stickiness using a laboratory-scale test rig utilizing 8 intake valves and valve guides, which simultaneously measures the pressure per unit time required to open each valve when using the applied fuel additive. This technique is based on CEC F-16-96 and is operated at −20° C. As with Example 1, the additives tested in this Example were identical in amounts and compositions except for the carrier fluid. Table 4 below and FIG. 2 shows the decrease in valve stick of the fuel additives when using the inventive blended carrier fluids herein.

TABLE 4

| Sample | | Detergent | Starter Alcohol | Propylene Oxide (Moles or repeating units) | Average Intake Valve Stickiness (lbs-sec) |
|---|---|---|---|---|---|
| Fuel Additive 1 | Inventive | Mannich | Alfol 1618CG | 24 | 2609 |
| Fuel Additive 2 | Inventive | Mannich | Alfol 1618CG | 28 | 2464 |
| Fuel Additive 3 | Comparative | Mannich | Nonylphenol | 24 | 3975 |

Example 3

The three fuel performance additives of Example 1 were further tested for their ability to control engine deposits by combining the additives in a fuel and evaluating intake valve deposits (IVD) using a Ford 2.3 liter engine and following ASTM D6201. As with Example 1, the fuels and additives tested in this Example were identical except for the carrier fluid type and the treat rates of the carrier fluids as noted in Table 5 below. The fuel additives were added to a fuel in the amounts noted below and in a ratio of detergent to carrier fluid of about 1:0.5. The detergent in this Example and previous Examples was a Mannich-based detergent as disclosed in U.S. Pat. No. 6,800,103. Table 5 below and FIG. 3 show the unexpected effect that the blended carrier fluids of this disclosure had on IVD. As discussed previously, carrier fluids are not known to exhibit detergent capabilities; thus, it was not expected to see the drop in IVS as shown in Example 2 and, at the same time, the decrease in IVD shown in this Example.

TABLE 5

| Sample | Fuel Additive | | Starter Alcohol | Propylene Oxide (Moles or repeating units) | Treat Rate of Fuel Performance Additive, PTB* | Treat Rate of Carrier Fluid, PTB | Average IVD, mg | Improvement from Control |
|---|---|---|---|---|---|---|---|---|
| Fuel A | Fuel Additive 3 | Comparative | Nonylphenol | 24 | 63.8 | 10.4 | 161 | control |
| Fuel B | Fuel Additive 1 | Inventive | Alfol 1618CG | 24 | 63.8 | 10.4 | 109 | 32% |
| Fuel C | Fuel Additive 2 | Inventive | Alfol 1618CG | 28 | 63.8 | 10.4 | 72 | 55% |
| Fuel D | Fuel Additive 2 | Inventive | Alfol 1618CG | 28 | 54.2 | 8.8 | 143 | 11% |

*PTB refers to pounds per 1000 barrels of fuel

As shown in Table 5, the inventive carrier fluids, when combined in a fuel, resulted in unexpected decreases in IVD when used at the same treat rate as the control fuel A. Specifically, fuel additives 1 and 2 resulted in about 32% and about 55% better IVD as compared to the control when treated in fuel at the same treat rate (i.e., 63.8 PTB). When the inventive carrier fluid blends were added 15% less to the fuel (i.e., 54.2 PTB), the carrier fluid still exhibited 11% less intake valve deposits. Again, this result is unexpected because carrier fluids were not known to have a detergent affect in fuels.

Example 4

Fuel additives were tested to evaluate how the type of alcohol used to form the carrier fluid or the molecular weight of the resulting carrier fluid in the fuel additive affected intake valve deposits (IVD) in a Ford 2.3 liter engine using ASTM D6201. The carrier fluids evaluated for this Example were all hydrocarbyl alcohols reacted with either 24 or 28 moles or repeating units of propylene oxide.

The following fuels and fuel additives were evaluated: Fuel E was a comparative sample and included a fuel additive with at least a detergent and carrier fluid of the conventional nonylphenolic alcohol reacted with 24 moles or repeating units of propylene oxide of Example 1. Fuel F was also comparative and included a fuel additive with at least a detergent and a carrier fluid of 2-ethylhexyl alcohol reacted with 24 moles or repeating units of propylene oxide. Thus, the carrier fluid of fuel F included a branched hydrocarbyl terminus with only six carbons. Fuel G was an inventive sample including a fuel additive with at least a detergent and a blended carrier fluid with approximately 70 weight percent C18 linear hydrocarbyl alcohol reacted with 24 moles or repeating units of propylene oxide and about 30 weight percent C16 linear hydrocarbyl alcohol reacted with 24 moles or repeating units of propylene oxide. A further inventive fuel sample (Fuel H) was also tested using the same fuel, fuel additive components, and amounts thereof except using a carrier fluid of a blended alcohol with approximately 70 weight percent C18 linear hydrocarbyl alcohol reacted with 28 moles or repeating units of propylene oxide and about 30 weight percent C16 linear hydrocarbyl alcohol reacted with 28 moles or repeating units of propylene oxide. The fuels evaluated for this Example all included the same fuel, fuel additive components, and in the same amounts. The only variable was the type of carrier fluid in the fuel additive.

Table 6 below and FIGS. 4 and 5 demonstrates how poly(oxyalkylene) polymers capped with either an aromatic hydrocarbyl group or only a six carbon chain hydrocarbyl group resulted in higher IVD values over the inventive sample with the blended C16 and C18 alcohol carrier fluid of the disclosure herein.

TABLE 6

| Sample | | Detergent | Starter Alcohol | Propylene Oxide (Moles or repeating units) | Treat Rate of Fuel Performance Additive, PTB | Treat Rate of Carrier Fluid, PTB | Average IVD, mg |
|---|---|---|---|---|---|---|---|
| Fuel E | Comparative | Mannich | Nonylphenol | 24 | 63.8 | 10.4 | 136 |
| Fuel F | Comparative | Mannich | 2-ethylhexanol | 24 | 62 | 10.3 | 258 |
| Fuel G | Inventive | Mannich | Alfol 1618CG | 24 | 63.8 | 10.4 | 109 |
| Fuel H | Inventive | Mannich | Alfol 1618CG | 28 | 63.8 | 10.4 | 72 |

Example 5

Further testing was completed to evaluate the intake valve stick as described in Example 2 when using different starter alcohols to form the carrier fluids. In this Example, fuel additives with at least a detergent and carrier fluid were evaluated. Five different carrier fluids were tested. Each was a hydrocarbyl alcohol reacted with 24, 28, or 30 moles or repeating units of propylene oxide, but each carrier fluid included a different hydrocarbyl terminus. Each fuel additive included at least a Mannich detergent and carrier fluid. The composition and amounts of components of each fuel additive was the same except for the carrier fluid type:

- Comparative fuel additive 4 included the conventional nonylphenolic alcohol reacted with 24 moles or repeating units of propylene oxide of Example 1.
- Comparative fuel additive 5 included the 2-ethylhexyl alcohol reacted with 24 moles or repeating units of propylene oxide described in Example 4.
- Inventive fuel additive 6 included a blended carrier fluid of approximately 70 weight percent C18 linear hydrocarbyl alcohol reacted with 24 moles or repeating units of propylene oxide and about 30 weight percent C16 linear hydrocarbyl alcohol (Alfol 1618CG) reacted with 24 moles or repeating units of propylene oxide.

Inventive fuel additive 7 included a blended carrier fluid of approximately 70 weight percent C18 linear hydrocarbyl alcohol reacted with 28 moles or repeating units of propylene oxide and about 30 weight percent C16 linear hydrocarbyl alcohol (Alfol 1618CG) reacted with 28 moles or repeating units of propylene oxide.

Inventive fuel additive 8 included a blended carrier fluid of approximately 30 weight percent C18 linear hydrocarbyl alcohol reacted with 28 moles or repeating units of propylene oxide and about 70 percent C16 linear hydrocarbyl alcohol (Alfol 1618GC) reacted with 28 moles or repeating units of propylene oxide.

Table 7 below and FIGS. 6 and 7 provide the results of this Example.

TABLE 7

| Sample | | Detergent | Starter Alcohol | Propylene Oxide (Moles or repeating units) | Average Intake Valve Stickiness (lbs-sec) |
|---|---|---|---|---|---|
| Fuel additive 4 | Comparative | Mannich | Nonylphenol | 24 | 3597 |
| Fuel additive 5 | Comparative | Mannich | 2-ethylhexanol | 24 | 1844 |
| Fuel additive 6 | Inventive | Mannich | Alfol 1618CG | 24 | 2609 |
| Fuel additive 7 | Inventive | Mannich | Alfol 1618CG | 28 | 2176 |
| Fuel additive 8 | Inventive | Mannich | Alfol 1618GC | 28 | 2947 |

While fuel additive 5 provided good IVS, it did not provide the improved IVD of the inventive carrier fluids of this disclosure as shown previously in Example 4. Fuel F evaluated in Example 4 included the same carrier as comparative fuel additive 5 of this example using the 2-ethylhexyl alcohol reacted with 24 moles or repeating units of propylene oxide. Comparing the results of Example 4 and this Example show that the discovered blended carrier fluids achieve acceptable IVS and, at the same time, unexpected improvement in IVD not normally associated with carrier fluid use in fuels.

Example 6

A number of tests were conducted to evaluate the impact of carrier fluid molecular weight on intake valve stick (IVS) using the test for IVS as described in Example 2. Table 8 and FIG. 8 show various IVS test results of fuel additives. The tested fuel additives include one or more detergents and the following carrier fluids:

Comparative fuel additive 9 included the conventional nonylphenolic alcohol reacted with 24 moles or repeating units of propylene oxide of Example 1.

Comparative fuel additive 10 included the 2-ethylhexyl alcohol reacted with 24 moles or repeating units of propylene oxide described in Example 4.

Comparative fuel additive 11 included 2-ethylhexyl alcohol reacted with 30 moles or repeating units of propylene oxide.

Comparative fuel additive 12 included 2-ethylhexyl alcohol reacted with 35 moles or repeating units of propylene oxide.

Inventive fuel additive 13 included a blended carrier fluid of approximately 70 weight percent C18 linear hydrocarbyl alcohol reacted with 24 moles or repeating units of propylene oxide and about 30 weight percent C16 linear hydrocarbyl alcohol reacted with 24 moles or repeating units of propylene oxide.

Inventive fuel additive 14 included a blended carrier fluid of approximately 70 weight percent C18 linear hydrocarbyl alcohol reacted with 28 moles or repeating units of propylene oxide and about 30 weight percent C16 linear hydrocarbyl alcohol reacted with 28 moles or repeating units of propylene oxide.

Comparative fuel additive 15 included a blended carrier fluid of approximately 70 weight percent C18 linear hydrocarbyl alcohol reacted with 35 moles or repeating units of propylene oxide and about 30 weight percent C16 linear hydrocarbyl terminated alcohol reacted with 35 moles or repeating units of propylene oxide.

Table 8 below and FIG. 8 provide the results of this Example.

TABLE 8

| Sample | | Starter Alcohol | Propylene Oxide (Moles or repeating units) | Average Intake Valve Stickiness (lbs-sec) |
|---|---|---|---|---|
| Fuel additive 9 | Comparative | Nonylphenol | 24 | 3044 |
| Fuel additive 10 | Comparative | 2-ethylhexanol | 24 | 1418 |
| Fuel additive 11 | Comparative | 2-ethylhexanol | 30 | 1636 |
| Fuel additive 12 | Comparative | 2-ethylhexanol | 35 | 3153 |
| Fuel additive 13 | Inventive | Alfol C1618CG | 24 | 1210 |
| Fuel additive 14 | Inventive | Alfol C1618CG | 28 | 1575 |
| Fuel additive 15 | Comparative | Alfol C1618CG | 35 | 3949 |

Example 7

Intake valve stick was further evaluated using a vehicle test conducted according to methods available at the Southwest Research Institute or SWRI (San Antonio, Tex.) using a Volkswagen Vanagon vehicle, which are incorporated by reference herein in their entirety. In this test, the tested fuel additives were combined with a fuel and then operated according to the SWRI valve sticking test except at −20° C. As with the other testing, each tested fuel included the same fuel, same fuel additives, and amounts thereof except that the type of carrier fluid in the fuel additive was varied. The following fuels were evaluated. Each evaluated fuel included the same amounts of a fuel additive with at least a detergent and the following carrier fluids:

- Comparative fuel I included the conventional nonylphenolic terminated alcohol with 24 moles or repeating units of propylene oxide of Example 1.
- Comparative fuel J included the 2-ethylhexyl terminated alcohol with 24 moles or repeating units of propylene oxide described in Example 4.
- Inventive fuel K included a blended carrier fluid of approximately 70 weight percent C18 linear hydrocarbyl terminated alcohol with 24 moles or repeating units of propylene oxide and about 30 percent C16 linear hydrocarbyl terminated alcohol with 24 moles or repeating units of propylene oxide.
- Inventive fuel L included a blended carrier fluid of approximately 70 weight percent C18 linear hydrocarbyl terminated alcohol with 28 moles or repeating units of propylene oxide and about 30 percent C16 linear hydrocarbyl terminated alcohol with 28 moles or repeating units of propylene oxide.

Table 9 and FIG. 9 illustrate the results of this evaluation

TABLE 9

| Sample | | Detergent | Starter Alcohol | Propylene Oxide (Moles or repeating units) | Total # of Stuck Valves |
|---|---|---|---|---|---|
| Fuel I | Comparative | Mannich | Nonylphenol | 24 | 3 |
| Fuel J | Comparative | Mannich | 2-ethylhexanol | 24 | 0 |
| Fuel K | Inventive | Mannich | Alfol C1618CG | 24 | 1 |
| Fuel L | Inventive | Mannich | Alfol C1618CG | 28 | 1 |

Similar to Example 5, while Fuel J using the 2-ethylhexyl carrier fluid resulted in good intake valve stick results, this carrier fluid resulted in the highest average intake valve deposits as shown in Example 4 and was thus unacceptable in the context of the present disclosure.

The illustrative embodiments have been described hereinabove. It will be apparent to those skilled in the art that the above compositions and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A fuel additive composition for spark-ignitable fuels, the fuel additive composition comprising a Mannich reaction product formed by condensing a long chain aliphatic hydrocarbon-substituted phenol or cresol with an aldehyde and an amine and at least one liquid carrier including a blend of aliphatic C16 to C18 alkoxylated alcohols with each alkoxylated alcohol of the blend having 24 to 32 repeating units of alkylene oxide, wherein the alkoxylated alcohols are prepared from alkylene oxides selected from the group consisting of ethylene oxide, propylene oxide, butylene oxide, copolymers thereof, and combinations thereof.

2. The fuel additive composition of claim 1, wherein a weight average molecular weight of the blend is about 1300 to about 2600.

3. The fuel additive composition of claim 1, wherein the blend includes about 30 to about 70 weight percent of a linear or branched aliphatic C16 alkoxylated alcohol having 24 to 32 repeating units of alkylene oxide.

4. The fuel additive composition of claim 1, wherein the blend further includes about 6 weight percent or less of C20 or greater alkoxylated alcohols and/or about 4 percent or less of C14 or lower alkoxylated alcohols.

5. A fuel composition comprising a spark-ignitable hydrocarbon fuel and the fuel additive composition of claim 1.

6. The fuel composition of claim 5, wherein a weight average molecular weight of the blend is 1300 to 2600.

7. The fuel composition of claim 5, wherein the blend of aliphatic C16 to C18 alkoxylated alcohols includes about 30 to about 70 weight percent of a linear or branched aliphatic C16 alkoxylated alcohol having 24 to 32 repeating units of alkylene oxide.

8. The fuel composition of claim 5, wherein the blend of the at least one liquid carrier includes about 6 weight percent or less of C20 or greater alkoxylated alcohols and/or about 4 percent or less of C14 or lower alkoxylated alcohols.

9. A method for controlling intake valve deposits and intake valve stick, the method comprising providing a fuel to a spark ignition internal combustion engine and operating the spark ignition internal combustion engine, the fuel containing a fuel additive composition with a Mannich reaction product formed by condensing a long chain aliphatic hydrocarbon-substituted phenol or cresol with an aldehyde and an amine and at least one liquid carrier including a blend of aliphatic C16 to C18 alkoxylated alcohols with each alkoxylated alcohol of the blend having 24 to 32 repeating units of alkylene oxide, wherein the alkoxylated alcohols are prepared from alkylene oxides selected from the group consisting of ethylene oxide, propylene oxide, butylene oxide, copolymers thereof, and combinations thereof.

10. The method of claim 9, wherein a weight average molecular weight of the blend is 1300 to 2600.

11. The method of claim 9, wherein the blend of aliphatic C16 to C18 alkoxylated alcohols includes about 30 to about 70 weight percent of a linear or branched aliphatic C16 alkoxylated alcohol having 24 to 32 repeating units of alkylene oxide.

12. The method of claim 9, wherein the blend of the at least one liquid carrier includes about 6 weight percent or less of C20 or greater alkoxylated alcohols and/or about 4 percent or less of C14 or lower alkoxylated alcohols.

13. The fuel additive composition of claim 1, wherein the blend includes about 30 to about 70 weight percent of a linear or branched aliphatic C18 alkoxylated alcohol having 24 to 32 repeating units of alkylene oxide.

14. The fuel additive composition of claim 13, wherein the blend includes about 30 to about 70 weight percent of a linear or branched aliphatic C16 alkoxylated alcohol having 24 to 32 repeating units of alkylene oxide.

15. The fuel additive composition of claim 14, wherein the fuel additive composition includes about 2 to about 4 times more of the linear or branched aliphatic C18 alkoxylated alcohol than the linear or branched aliphatic C16 alkoxylated alcohol.

16. The method for controlling intake valve deposits and intake valve stick of claim 9, wherein the blend includes about 30 to about 70 weight percent of a linear or branched aliphatic C18 alkoxylated alcohol having 24 to 32 repeating units of alkylene oxide.

17. The method for controlling intake valve deposits and intake valve stick of claim 16, wherein the blend includes about 30 to about 70 weight percent of a linear or branched aliphatic C16 alkoxylated alcohol having 24 to 32 repeating units of alkylene oxide.

18. The method for controlling intake valve deposits and intake valve stick of claim 17, wherein the fuel additive composition includes about 2 to about 4 times more of the linear or branched aliphatic C18 alkoxylated alcohol than the linear or branched aliphatic C16 alkoxylated alcohol.

* * * * *